US008893403B2

(12) United States Patent
Möhlmann

(10) Patent No.: US 8,893,403 B2
(45) Date of Patent: Nov. 25, 2014

(54) SOLE CONSTRUCTION HAVING AN AIR PUMPING DEVICE

(71) Applicant: Wilhelm Möhlmann, Zurich (CH)

(72) Inventor: Wilhelm Möhlmann, Zurich (CH)

( * ) Notice: Subject to any disclaimer, the term of this patent is extended or adjusted under 35 U.S.C. 154(b) by 0 days.

(21) Appl. No.: 14/035,078

(22) Filed: Sep. 24, 2013

(65) Prior Publication Data

US 2014/0013632 A1 Jan. 16, 2014

Related U.S. Application Data

(63) Continuation-in-part of application No. PCT/EP2011/001487, filed on Mar. 24, 2011.

(51) Int. Cl.
*A43B 7/06* (2006.01)
*A43B 7/08* (2006.01)

(52) U.S. Cl.
CPC .. *A43B 7/06* (2013.01); *A43B 7/081* (2013.01)
USPC ..... 36/3 R; 36/3 B

(58) Field of Classification Search
USPC ..... 36/3 R, 3 B, 29
See application file for complete search history.

(56) References Cited

U.S. PATENT DOCUMENTS

| | | | | |
|---|---|---|---|---|
| 3,331,146 | A | 7/1967 | Karras | |
| 5,138,775 | A | 8/1992 | Chu | |
| 5,375,345 | A | 12/1994 | Djuric | |
| 5,505,010 | A * | 4/1996 | Fukuoka | 36/3 B |
| 5,701,687 | A * | 12/1997 | Schmidt et al. | 36/29 |
| 5,771,606 | A * | 6/1998 | Litchfield et al. | 36/29 |
| 5,826,349 | A | 10/1998 | Goss | |
| 5,956,869 | A * | 9/1999 | Kim | 36/29 |
| 6,085,444 | A | 7/2000 | Cho | |
| 6,370,799 | B1 * | 4/2002 | Thatcher | 36/3 B |
| 6,370,800 | B1 * | 4/2002 | Hung | 36/3 B |
| 6,415,529 | B1 * | 7/2002 | Kelley | 36/3 R |
| 6,581,303 | B1 | 6/2003 | Tuan | |
| 6,745,499 | B2 * | 6/2004 | Christensen et al. | 36/29 |
| 7,328,525 | B2 | 2/2008 | Lim | |
| 7,578,074 | B2 * | 8/2009 | Ridinger | 36/3 R |
| 7,681,329 | B2 * | 3/2010 | Fu | 36/3 B |
| 2002/0194747 | A1 | 12/2002 | Passke et al. | |
| 2004/0010939 | A1 * | 1/2004 | Liu et al. | 36/29 |
| 2004/0221481 | A1 * | 11/2004 | Regen | 36/3 B |
| 2005/0005473 | A1 * | 1/2005 | Oh | 36/29 |
| 2005/0283997 | A1 | 12/2005 | Wang | |
| 2006/0117605 | A1 * | 6/2006 | Michaeli | 36/29 |
| 2006/0156575 | A1 | 7/2006 | Lo | |
| 2006/0272179 | A1 | 12/2006 | Passke et al. | |
| 2007/0068037 | A1 | 3/2007 | Ridinger | |
| 2007/0094891 | A1 * | 5/2007 | Myslinski | 36/3 R |
| 2008/0052967 | A1 * | 3/2008 | Fu | 36/3 B |
| 2008/0163517 | A1 * | 7/2008 | Chen | 36/3 B |
| 2011/0167679 | A1 * | 7/2011 | Graziani et al. | 36/3 R |
| 2011/0265352 | A1 * | 11/2011 | Lin | 36/3 B |

FOREIGN PATENT DOCUMENTS

| | | |
|---|---|---|
| CN | 2688104 Y | 3/2005 |
| CN | 2728270 Y | 9/2005 |
| DE | 7611551 U1 | 8/1976 |
| DE | 9317522 U1 | 2/1994 |

(Continued)

*Primary Examiner* — Marie Bays

(57) ABSTRACT

The invention relates to a sole construction for a shoe, comprising an upper sole part, which has channels, a lower outsole part, and an air pumping device, which is connected to the channels and which is substantially formed in the upper sole part.

5 Claims, 4 Drawing Sheets

(56) References Cited

FOREIGN PATENT DOCUMENTS

| | | | |
|---|---|---|---|
| DE | 19924256 | C1 | 3/2001 |
| DE | 69710492 | T2 | 10/2002 |
| DE | 60012874 | T2 | 9/2005 |
| DE | 202005013490 | U1 | 12/2005 |
| EP | 0714611 | B1 | 6/1966 |
| EP | 0479183 | A2 | 4/1992 |
| EP | 0624322 | A1 | 11/1994 |
| EP | 1127505 | A1 | 8/2001 |
| GB | 2262024 | A | 6/1993 |
| GB | 2429396 | A2 | 2/2007 |
| JP | 2001258605 | A | 9/2001 |
| WO | 9701971 | | 1/1997 |
| WO | 0001266 | A1 | 1/2000 |
| WO | 03043454 | A2 | 5/2003 |

* cited by examiner

SOLE CONSTRUCTION HAVING AN AIR PUMPING DEVICE

CROSS-REFERENCE TO RELATED APPLICATION

This is a continuation-in-part of co-pending International Patent Application PCT/EP2011/001487, which has an international filing date of Mar. 24, 2011, the entire disclosure of which is incorporated herein by reference.

FIELD OF THE INVENTION

The present invention relates to a sole construction for footwear which during every step of the walking motion enables efficient air circulation inside the shoe, and thereby directly at the foot of a wearer of the shoe.

BACKGROUND OF THE INVENTION

Nowadays, shoes are known that are equipped with devices in the sole, which promote the circulation of air in the shoe, thereby reducing the internal moisture, whereby the user's foot comfort is to be improved. This known type of shoes suffers from a lack of efficiency of air circulation in the shoe.

DE 600 12 874 T2 describes a shoe in which air is sucked from the shoe interior, and the air thus sucked is discharged to the outside of the shoe, U.S. Pat. No. 6,581,303 B1 describes the ventilation of a shoe using a pump which is part of an inlay provided between an outer sole and an inner sole. DE 93 17 522 U1 describes a shoe sole with inlet openings for air inside the shoe.

DE 76 11 551 U describes a boot with a rubber sole and an upper. The one-piece rubber sole comprises an upper sole part with an air pumping device in the form of a lens-shaped cavity formed in a heel of the sole and a lower outsole part. A fresh air intake channel 16 is guided along the upper of the boot (feature 5.1). DE 697 10 492 T2 describes footwear with air circulation having compressible chambers provided between an outsole and a comfort inlay. U.S. Pat. No. 7,238,525B2 describes a sole construction in which air enters from the outside via an air channel into an air chamber and an air passage. DE 20 2005 013 490 U1 describes a sole inlay for air circulation.

The object therefore arises to provide a show with sole construction which ensures more efficient and more continuous air circulation than could to date be achieved in prior art.

BRIEF SUMMARY OF THE INVENTION

The above object is satisfied by a shoe with a sole construction and a shaft of a shoe ("Schuhschaft"), said sole construction comprising an upper sole part which has channels;

a lower outsole part; and an air pumping device which is connected to the channels and substantially formed in the upper sole part; where the lower outsole part at the outer tread area in the region of the air pumping device comprises a raised portion which is adapted to be pressed in the direction of the upper sole part when the user's foot applies pressure; an the effect of which is formed by the cooperation of the upper sole part and the lower outsole part;

at least one first air guide connected with the air pumping device; and at least one second air guide connected on one side with the air pumping device and on an opposite side with the channels, and where the air pumping device is adapted to perform an air pumping function in response to a walking motion of a user of the shoe, such that it alternatingly sucks in air via the at least one first air guide from outside of the sole construction and forces air into the channels which are in communication with the air pumping device via the at least one second air guide;

and where, in the at least one first air guide, a first valve is arranged such that it is configured to allow air to pass only in the direction from outside of the sole construction into the air pumping device; and/or where, in the at least one second air guide, a second valve is arranged such that it is configured to allow air to pass only in the direction from the air pumping device to the channels; and where the shaft of a shoe comprises a sole construction proximal part and a sole construction distal part, and in which the first air guide extends partially along the shaft of a shoe, in particular, separated by an inner lining of the shaft of a shoe from the foot of the wearer of the shoe, from the proximal part to the distal part, such that air from the distal part can be pumped into the air pumping device.

In the present application, the terms up, upper etc. refer to positions that are farther distanced from a ground, that is contacted by the sole construction during use in a shoe, than positions, which are referred to by terms such as down, lower, etc.

The lower surface of the lower outsole part therefore contacts the ground trodden on by a user of the shoe when using a shoe with the sole construction according to the invention. Said first and second sole part of the sole construction can be formed separately, but they can also form portions of a sole body formed in one piece, so that they form an integral block.

According to the invention, the air pumping device sucks in air from outside of the shoe and distributes it in the channels. The air pumping device is adapted to perform an air pumping function with the sole construction according to the invention in response to a walking motion of a user of the shoe such that it alternatingly sucks in air via at least one air guide from outside of the sole construction or the shoe when the user's foot releases pressure, and distributes air via the air channels in the shoe when the user's foot applies pressure to the air pumping device. The air pumping device can be provided from the heel region extending from the end of the foot to the joint region, in the central joint region and/or the ball portion (forefoot region), extending from the front end of foot up to the joint region.

The feature, that the air pumping device is formed substantially in the upper sole part, means that the air pumping device is at least by more than 50% formed in the upper sole part (and less than 50% in the lower outsole part), even if it may be formed overall by a cooperation of the upper sole part and the lower outsole part. This feature can in particular indicate that the air pumping device is formed by at least more than 80%, in particular more than 90%, in particular more than 95% in the upper sole part.

In the sole construction, at least the portion of the upper sole part, in which the air pumping device is formed, can be designed more elastically than the lower outsole part. This more elastic design can achieve a pumping effect across the entire sole, i.e. from the heel via the joint to the ball.

An efficient pumping effect is achieved, due to the fact that the portion of the upper sole part, in which the air pumping device is formed, is designed more elastically than the lower outsole part. When the user's foot applies pressure, this more elastic region is pushed downwardly (towards the tread area)

and can thereby operate the air pumping device to the effect that it forces air from the air pumping device and through the channels. The pumping effect can be further enhanced by the fact that the lower outsole part at the outer tread area (which in the course of a walking motion is in contact with the ground on which a user of a shoe with the sole construction according to the invention is walking) in the region of the air pumping device comprises a raised portion which is adapted to be pressed in the direction of the upper sole part when the user's foot applies pressure. The raised portion can be designed thinner than the other regions of the lower outsole part. Not only efficient air circulation is ensured by the fact that the raised portion is during pressure application pressed in, but walking comfort is also increased due to the shock-absorbing function of the air pumping device.

According to alternative developments, the air pumping device is formed substantially by a cavity embedded into the upper sole part, or the air pumping device is formed separately as an independent entity and is fully or partially embedded in a cavity of the upper sole part. The volume content of the cavity formed in the upper sole part is greater than that which is provided by the lower outsole part when forming the cavity acting as the air pumping device. In particular, the cavity can be formed in the upper sole part by more than 80%, in particular more than 90%, in particular more than 95%. According to one development, the air pumping device is provided in the form of a cavity filled with elastic filling material permeable to air.

The use of only one cavity formed as an air pumping device simplifies the manufacturing process, reduces production costs and increases reliability and durability of the air pumping device. The use of a separate air pumping device designed as a separate entity can improve the efficiency of the air circulation.

For example, the air pumping device can comprise a plastic pump reservoir as a separate entity. When the user's foot puts pressure onto it, it is pressed together, whereby air is forced out of the plastic pump reservoir. When the plastic pump reservoir is during the walking motion again relieved of the pressure by the foot, it expands and, due to the negative pressure previously generated, draws in air from the outside, which is then available for subsequent ventilation of the shoe interior and thereby for the user's foot. Furthermore, the air pumping device can be integrally formed in one piece with the plastic pump reservoir and the air channels. The design of the air pumping device as a separate entity allows selecting material and in particular material strength, independent of the sole construction or the sole body, respectively.

In the examples described above, openings can be provided along the channels in the upper sole part such that air flowing through the channels can pass through the openings to above the upper sole part, i.e. into the interior of a shoe comprising the sole construction according to the invention. Due to the pumping effect of the air pumping device when the user applies pressure with his foot, air is pumped through the channels and the openings provided therein for ventilation of the foot in the interior of the shoe in which the foot is located.

According to one example, tubes can also be provided from the air pumping device along the channels, in which air from the air pumping device flows. In this case, the tubes must have openings corresponding to those which can be provided in the upper sole part. The tubes can be manufactured, for example, from silicone.

As already mentioned, the upper sole part and the lower outsole part can be separately formed, or the upper sole part and the lower outsole part can form be integrally, in one piece, i.e., as an integral block. In the first case, the upper sole part and the lower outsole part can be formed from different materials, or they can be formed from the same material. In the latter case, the sole design can be formed around a separate independently formed air pumping device, such that the upper sole part is more elastic at least in the region of the air pumping device (due to different thicknesses) than the lower outsole part. The sole construction is in this case produced from elastic material, for example, by plastic injection molding.

In one embodiment, the sole construction according to the invention can further comprise plastic tubes which are arranged in the channels, where the plastic tubes have openings along their longitudinal axes and are in fluid communication with the air pumping device.

Depending on the walking phase, outside air can according to the invention be sucked in by the air pumping device, and the previously sucked-in air can be discharged into the channels. When, in the corresponding walking phase, the user's foot is not pressing down on the air pumping device, it sucks in air from outside of the sole construction via the respective first air supply, when the foot is pressing down on it, it pumps the air via the respective second air supply into the channels from where it is forced upwardly to the user's foot, for example, through openings that are provided in the upward direction in the channels for effective ventilation of the user's foot.

Thereby, a sole construction is made available which provides improved air circulation in a simple design merely by the motion during walking, without the need for any significant increase in size compared with conventional sole constructions without air circulation. In this development, the valves provided allow for efficient control of air flow via the air guides into the air pumping device and out from there.

The second air guide can be embodied in the form of a tube or channel; it can also be provided only in the form of an outlet of the air pumping device, in particular, of an air reservoir of the air pumping device. In particular, the at least one first and/or the at least one second air guide can comprise a flexible hose and/or a covered channel, or respectively be made of a flexible hose, for example, be made of plastic. If several first and/or second air guides are provided, then they can all each comprise a tube or be made thereof, or some and not all of the air guides can each comprise a tube or be made thereof. Furthermore, the air guides can be formed integrally with a plastic pump reservoir of the air pumping device. According to these examples, the air guides can continuously and in an airtight manner, in a simple and inexpensive way, supply air to the air pumping device and from there for ventilation of at least a portion of the sole body, and ultimately to the interior of a shoe. The first air guide can be guided upwardly where it terminates, for example, in a shaft of a shoe of a shoe comprising the sole construction according to the invention, in order to there enable the suction of fresh air by the air pumping device.

According to the invention, fresh air basically can be drawn in over a relatively large area by the air pumping device. In particular, water ingress into the shoe from the outside is prevented when the end of the first air guide, through which air is sucked in from the outside, is from the perspective of the outsole located higher than the lowest upper end of the shoe.

BRIEF DESCRIPTION OF THE DRAWINGS

Other features and advantages of the invention will become apparent from the detailed but not restricting description of embodiments, which are illustrated using the accompanying drawings, wherein.

DETAILED DESCRIPTION OF THE INVENTION

Figure 1:
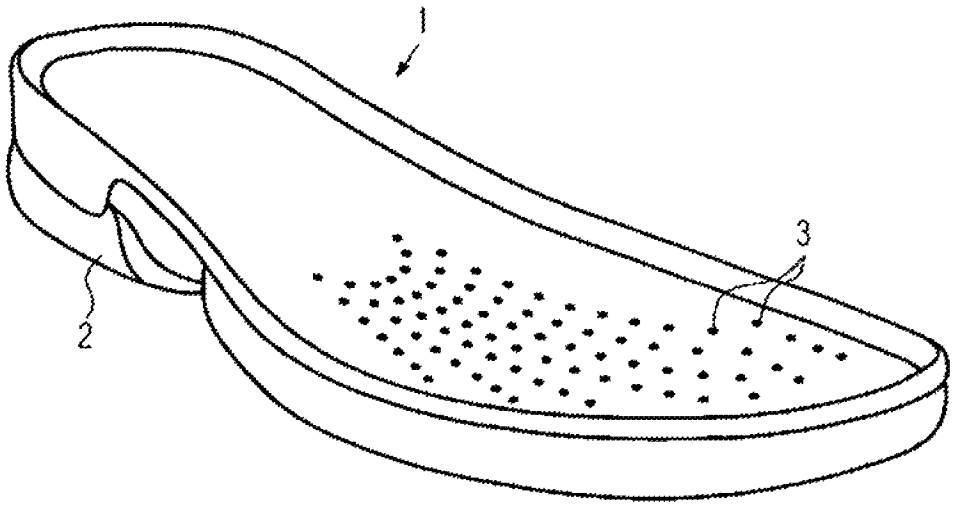
FIG. 1 shows the sole construction with an upper sole part and a lower outsole part according to one example of the invention.
Figure 2:
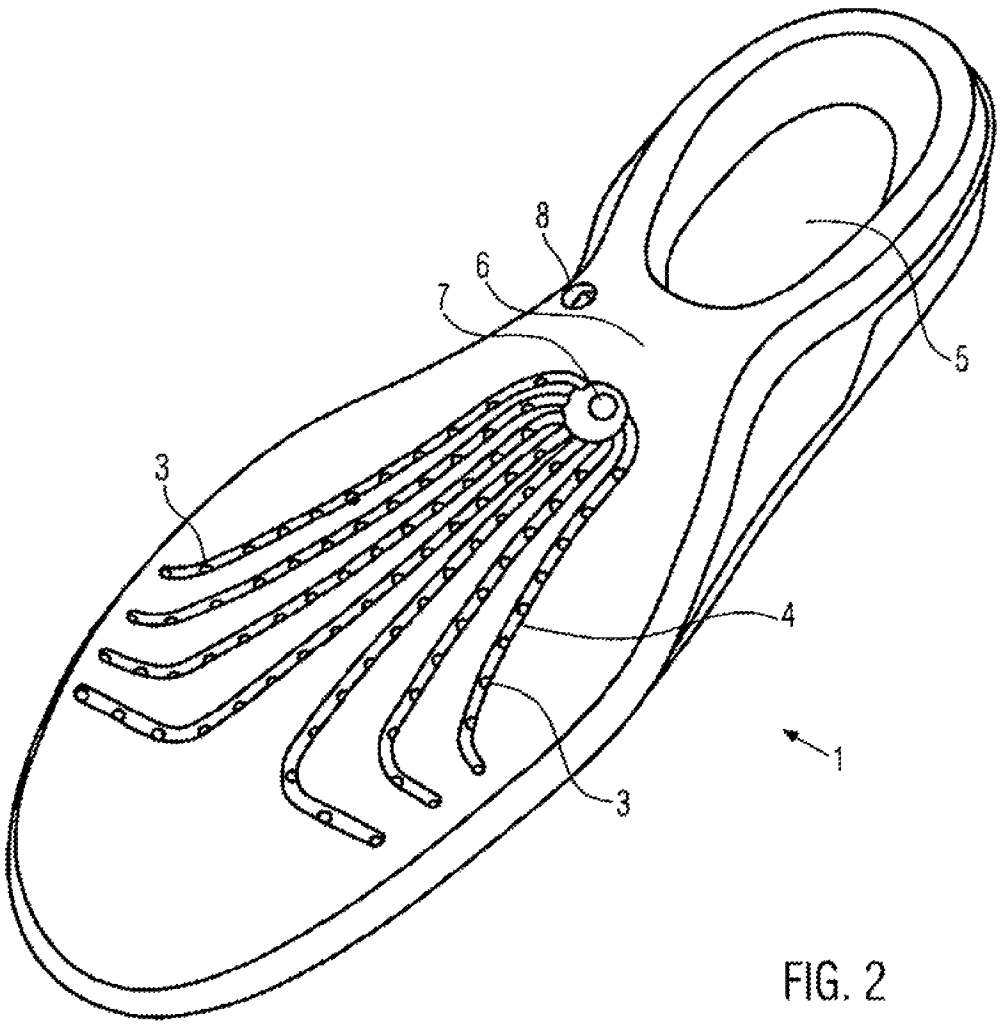
FIG. 2 represents an upper sole part of a sole construction according to one example of the invention.

As shown in FIG. 1, a sole construction according to an example of the present invention comprises an upper sole part 1, which may be referred to as an intermediate sole and a lower outsole part 2. In the example shown, the upper sole part 1 is formed from more elastic (more compressible) material than the lower outsole part 2. In the heel area, an air pumping device is formed, for example, in the form of a cavity or a plastic pump reservoir, as illustrated in FIG. 2, in which the upper sole part 1 is shown from below (from the perspective of the lower outsole part 2). For example, the upper sole part 1 can be made from relatively soft polyurethane whereas the outsole part 2 can be made from abrasion-resistant rubber. When applying pressure on the heel region, the air pumping device is pressed together, whereby air is forced out of it into the channels 4 shown in FIG. 2 comprising the openings 3. The air forced through the openings 3 then serves to ventilate a shoe interior and thereby the foot of a wearer of a shoe comprising the sole construction with the upper sole part 1 and the lower outsole part 2.

In the example of the upper sole part 1 shown in FIG. 2, a cavity 5 is provided in the heel region. This cavity can be the air pumping device, which according to the invention is provided in the upper sole part 1. Alternatively, a separate air pumping device in the form of a plastic pump reservoir can be provided in the cavity 5. At least the heel region of the sole part 1 is sufficiently compressible, so that when pressure is applied by the user's foot, i.e. when he during walking shifts his weight onto the heel region, it is compressed and thereby the volume of the cavity is reduced and the air from the cavity or a plastic pump reservoir arranged therein is forced into the channels 4. The air passes, for example, through a passage embedded in the intermediate part 6 (in which a valve can be provided) and via the outlet 7 into the system of channels 4.

According to one example, the air from the cavity 5 or the plastic pump reservoir disposed therein, respectively, can be passed into plastic tubes that are provided in the channels 4 and comprise openings being provided in correspondence to the openings 3 of the upper sole part 1. An air supply passed through a passage embedded in the intermediate part 6 and through the outlet 7 can connect the cavity or the plastic pump reservoir embedded therein, respectively, with the channels 4. A one-way valve can be provided in the air supply to ensure that air can flow only from the air pumping device to the channels 4 and can not vice versa (see also the description of FIG. 3 below). A single directional valve can be provided in the passage which is provided in the intermediate region 6 for controlling the air sucked in and discharged by the air pumping device.

In the example shown in FIG. 2, a further air guide is guided from the air pumping device through the passage 8 upwardly to the top in a shaft of a shoe of a shoe comprising the sole construction with the upper sole part 1, via which the fresh air is sucked into the air pumping device during the walking motion of a user when the heel region is pressed upon. The passage 8 is connected by a passage within the intermediate part 8 with the cavity 5 or the plastic pump reservoir disposed therein, respectively. This additional air guide can also be provided with a one-way valve which ensures that air enters the air pumping device when the pressure in heel region is released, but no air can escape to the outside through this further air guide when the heel region is pressed upon.

Figure 3:
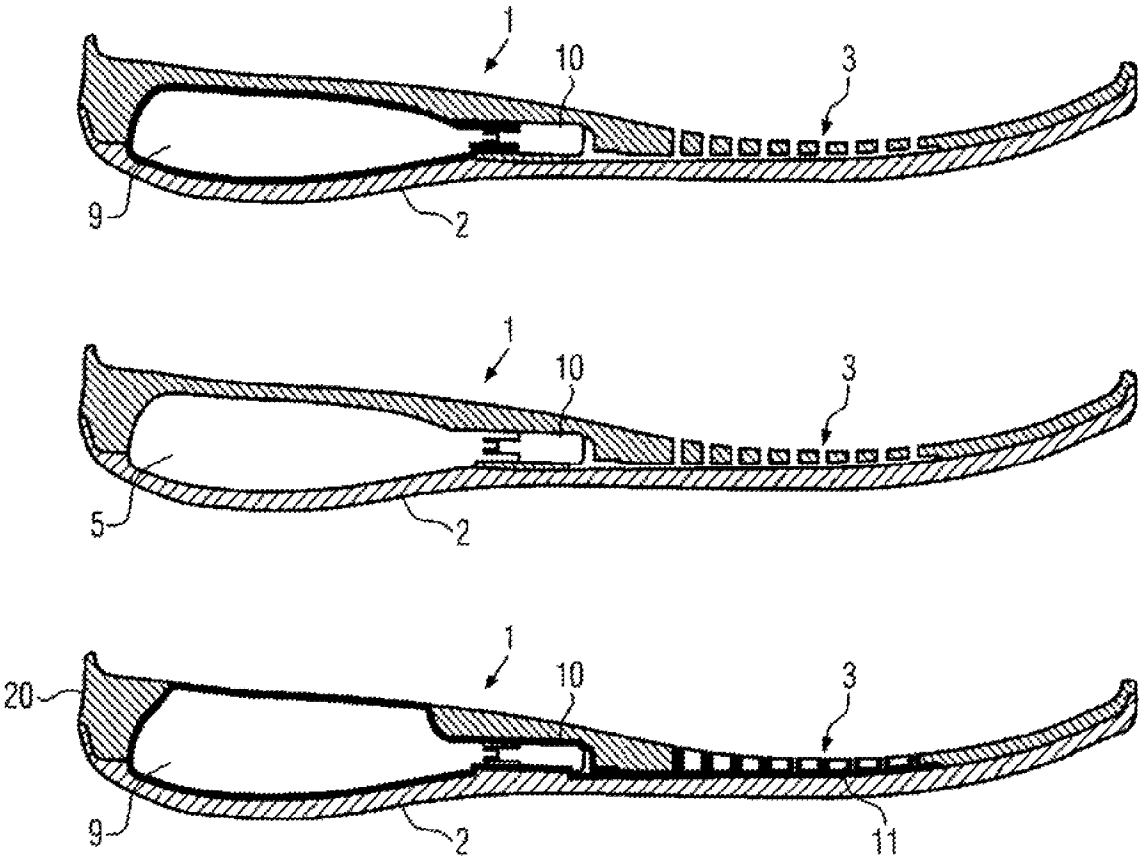
FIG. 3 shows sole constructions in cross-section according to different examples of the invention.

FIG. 3 shows three embodiments of the sole construction according to the invention by way of example in cross-section. In the top image of FIG. 3, an upper sole part 1 and a lower outsole part 2 form a sole construction. A cavity is formed in the heel region substantially by the upper sole part 1. The cavity is substantially completely filled by an air pumping device in the form of a plastic pump reservoir 9. When the foot (the heel) of a user applies pressure, the air pumping device is compressed and air is forced via the one-way valve 10 into the channels 4 illustrated in FIG. 2, from where it enters the interior of the shoe being provided with the sole construction via the openings 3.

To ensure this function of the plastic pump reservoir 9, the upper sole part 1 must be designed such that it yields to the pressure of the heel of a user's foot (inwardly). The material can be selected according to the gender of a user. An elevation provided in the heel region of the lower outsole part 2 can also, when pressure is applied to the heel region, be pressed inwardly under the user's weight, so that the pumping effect is supported. When the heel region is during the walking motion released of the pressure, a negative pressure is created in the plastic pump reservoir 9, by which air from the outside is sucked in through an air guide (not shown in FIG. 3) into the plastic pump reservoir 9. In this, the one-way valve 10 prevents that air is sucked in from the interior of the shoe through the channels into the plastic pump reservoir 9.

The center image of FIG. 3 shows a similar construction like that of the upper image, where the plastic pump reservoir 9 is there omitted. The air pumping device is therefore only formed by the cavity 5 which is compressed when the user's foot applies pressure, whereby air is forced through the one-way valve 10 into the channels 4 illustrated in FIG. 2, from where it reaches the interior of a shoe equipped with the sole construction via the openings 3.

In the bottom image of FIG. 3 finally, an integrally formed sole construction 20 is shown, in which the upper sole part 1 and the lower outsole part 2 are integrally formed in one block. The configuration shown comprises a plastic pump reservoir 9 as an air pumping device. The air pumping device can form a part of the upper surface of the upper sole part 1. Alternatively, the plastic pump reservoir 9 can be entirely enclosed by the material of the sole construction, as it is shown in the upper and center image in FIG. 3. Moreover, a tube system 11 is indicated through which air, which has passed the one-way valve 10 coming from the plastic pump reservoir 9, is guided through openings in the tubes through openings 3 of the upper sole part 1 for ventilating the interior of a shoe. An air pumping device used for this is illustrated in FIG. 4.

In general it should be noted that both channels with tubes disposed therein as well as channels without tubes can be provided in the embodiments shown in FIG. 3. A directional valve can also be provided at air guides connected to the air pumping device.

Figure 4:
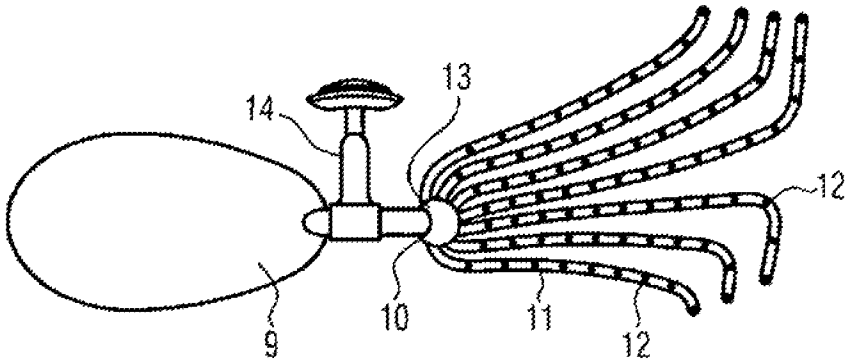
FIG. 4 shows an air pumping device with tubes that comprise openings along their longitudinal axis.

The air pumping device shown in FIG. 4 is formed by a plastic pump reservoir 9 from which air can be pumped through the one-way valve 10 into the tubes 11. The hoses 11 comprise openings 12 corresponding to openings 3 in the channels 4 of the upper sole part 1. The valve 10 is connected to a distributor element 13, into which the hoses 11 lead.

Another one-way valve 14 is closed against air which is pumped from the plastic pump reservoir 9 and allows only air supply from the outside into the plastic pump reservoir 9 when the plastic pump reservoir 9 is relieved of pressure during the walking motion of a user. Alternatively, a directional valve can be used instead of two one-way valves 10 and 14 (which is positioned between the positions of the valves 10 and 14) in order to control the air flow. This directional valve can be provided in the form of an alternating check valve, which, in dependency of the pressure operation of the air pumping device by the user's foot, controls the air flow such that the air is pumped in only from the outside into the air pumping device and only out into the tubes 11. The configuration shown in FIG. 4 can also be used in the embodiment shown in the upper image of FIG. 3.

The invention relates to a sole construction for a shoe, comprising an upper sole part, which has channels, a lower outsole part, and an air pumping device, which is connected to the channels and which is substantially formed in the upper sole part.

The invention claimed is:

1. Shoe with a sole construction and a shaft of a shoe, where said sole construction comprises an upper sole part which has channels;

a lower outsole part; and an air pumping device which is connected to said channels and formed substantially in said upper sole part;

where said lower outsole part at the outer tread area in the region of said air pumping device comprises a raised portion which is adapted to be pressed in the direction of said upper sole part when the user's foot applies pressure; and the effect of which is formed by the cooperation of said upper sole part and said lower outsole part;

at least one first air guide connected with said air pumping device;

and comprising at least one second air guide connected on one side with the air pumping device and on an opposite side with the channels, and where said air pumping device is adapted to perform an air pumping function in response to a walking motion of a user of said shoe, such that it alternatingly sucks in air via said at least one first air guide from outside of said sole construction and forces air into the channels which are in communication with the air pumping device via the at least one second air guide;

and where, in said at least one first air guide, a first valve is arranged, such that it is configured to allow air to pass only in the direction from outside of said sole construction into said air pumping device; and where in the at least one second air guide, a second valve is arranged, such that it is configured to allow air to pass only in the direction from the air pumping device to the channels;

and where said shaft of a shoe comprises a sole construction proximal part and a sole construction distal part, and in which said first air guide extends partially along said shaft of a shoe, in particular, separated by an inner lining of said shaft of a shoe from said foot of the wearer of said shoe, from said proximal part to said distal part, such that air from said distal part can be pumped into said air pumping device, where said upper sole part and said lower outsole part are formed separately;

where at least the portion of said upper sole part, in which said air pumping device is formed, is designed more elastically than said lower outsole part; and where said air pumping device is formed separately as an independent entity and is entirely or partially embedded in a cavity of said upper sole part.

2. Shoe according to claim 1, in which said air pumping device is formed by a cavity substantially embedded in said upper sole part.

3. Shoe construction according to claim 1, in which said air pumping device is formed by a cavity which is substantially embedded in said upper sole part and filled with elastic filling material permeable to air.

4. Shoe according to claim 1, in which openings are provided along said channels in said upper sole part, such that air flowing through said channels can pass through said openings to above said upper sole part.

5. Shoe according to claim 1, in which said sole construction further comprises plastic tubes which are arranged in said channels, where said plastic tubes further have openings along their longitudinal axes and are in fluid communication with said air pumping device.

* * * * *